US005191327A

United States Patent [19]

Talmadge et al.

[11] Patent Number: 5,191,327

[45] Date of Patent: Mar. 2, 1993

[54] PROGRAMMABLE REMOTE TRANSDUCER WITH FILTERING, DIFFERENTIATION, INTEGRATION, AND AMPLIFICATION

[75] Inventors: Richard D. Talmadge, New Lebanon, Ohio; Kenneth E. Appley, Orange; Salvatore DeFrancesco, East Haven, both of Conn.

[73] Assignee: The United States of America as represented by the Secretary of the Air Force, Washington, D.C.

[21] Appl. No.: 540,661

[22] Filed: Jun. 19, 1990

[51] Int. Cl.[5] ..... G08C 19/04

[52] U.S. Cl. ..... 340/870.38; 340/870.05; 340/870.37; 364/571.02; 364/571.06; 364/572

[58] Field of Search ..... 340/870.05, 870.11, 340/870.13, 870.21, 870.37, 870.38; 364/161, 162, 163, 174, 180, 186, 558, 565, 566, 570, 571.02, 571.06, 572; 370/112, 113; 379/106

[56] References Cited

U.S. PATENT DOCUMENTS

| | | | |
|---|---|---|---|
| 3,517,662 | 6/1970 | Finch et al. | 128/2.06 |
| 4,077,030 | 2/1978 | Helava . | |
| 4,158,765 | 6/1979 | Schauger et al. . | |
| 4,356,486 | 10/1982 | Mount | 340/870.38 |
| 4,451,826 | 5/1984 | Fasching | 340/825.07 |
| 4,626,769 | 12/1986 | Valley et al. | 364/162 |
| 4,628,315 | 12/1986 | Douglas | 340/870.26 |
| 4,638,451 | 1/1987 | Hester et al. | 364/900 |
| 4,783,659 | 11/1988 | Frick | 340/870.05 |
| 4,872,213 | 10/1989 | Sebald et al. | 364/180 |

OTHER PUBLICATIONS

Richard Talmadge and Kenneth E. Appley, "Programmable Transducer Microchip Development", discussed at the Range Commander's Council 15th Transducer Workshop on Jun. 21, 1989 at Cocoa Beach, Fla.

*Primary Examiner*—Donald J. Yusko
*Assistant Examiner*—John Giust
*Attorney, Agent, or Firm*—Gerald B. Hollins; Donald J. Singer

[57] ABSTRACT

A mechanical-to-electrical transducer arrangement wherein a combination of signal preamplifier and programmable analog signal processing circuitry is disposed immediately adjacent the transducer's sensor cell where low losses a low noise coupling into the signal path can be achieved. The programmable analog processing includes differentiation, filtering, integration, amplification and elective disconnection of the sensor cell to enable rapid transient signal recovery. Provisions for generation of transducer identification code and test signals in the processing circuitry and communications by way of a two wire time shared communication path is included.

16 Claims, 12 Drawing Sheets

PROGRAMMABLE REMOTE TRANSDUCER WITH FILTERING, DIFFERENTIATION, INTEGRATION, AND AMPLIFICATION

RIGHTS OF THE GOVERNMENT

The invention described herein may be manufactured and used by or for the Government of the United States for all governmental purposes without the payment of any royalty.

BACKGROUND OF THE INVENTION

This invention relates to the field of electrical transducer devices such as are commonly used in the measurement of small physical displacements, forces, vibrations, pressures, and accelerations and to the electronic circuitry used with such devices for signal processing.

In the civil engineering laboratory and in the design of airframes for aircraft, it has become common practice to employ transducers which include sensors such as the resistance strain gauge as measuring tools for evaluating the response of structural members to physical stressing.

Both the piezoelectric crystal and the electrical resistance strain gauge have, in fact, been applied to a great number of measurement situations in which physical phenomena can be characterized by a small change in a physical dimension. In the measurement of fluid pressure, for example, the displacement of a diaphragm is frequently coupled to a piezoelectric crystal sensor or a resistance strain gauge sensor in order that dimensional changes in such an element represent fluid pressure. In a related manner, sensors and transducers of this type are often used to measure the displacement, the displacement change with time (i.e., the velocity) and the change of velocity with time, (i.e., the acceleration), for the moving part.

In such measurements displacement and velocity are, in fact, mathematically related by the first derivative function and displacement and acceleration are similarly related by the second mathematical derivative. Speaking conversely, displacement is in fact mathematically the first integral of velocity and also the second integral of acceleration. These differential and integral relationships are particularly useful in many real world measurement situations where the behavior of a physically moving object is to be fully evaluated from a single transducer signals, as might conveniently occur, for example, in the widely diverse field of machinery designs, explosives development, and vehicle crash testing.

In test situations of this type, it is often convenient, therefore, to employ a single sensor or transducer device and to determine the three quantities of displacement, velocity, and acceleration for the tested element by mathematically operating on the electrical signals obtained from this one device. Provisions for such signal processing are, in fact, provided in the present invention.

According to another aspect of the heretofore practiced measurement systems, it has been common practice to locate one or more sensor or transducer devices in physical contact with a moving object and to couple the resulting signal to a collection of electronic instruments which are located some convenient distance away by using a low-level signal conducting electrical cable. In view of the small amplitude of signals generated by most transducer devices, the quality of the signal received at the distally located signal processing electronic apparatus is often greatly diminished by the presence of signal losses and noise introduced into the low-level signal conductors. An arrangement for improving upon this performance is also provided in the present invention.

The prior patent art discloses a number of systems in which signal data is communicated from a remote location to a processing station. Included in this prior art is the patent of U. V. Helava, U.S. Pat. No. 4,077,030, which teaches a system for transmitting data from a plurality of remote sensors to a digital processor, and the patent of N. F. Douglas, U.S. Pat. No. 4,628,315, which shows the use of an addressable transducer in a monitoring system having a central station and a frequency varying communication scheme between the remote sensor and the digital processor. Also included in this prior art is the U.S. Pat. No. 4,158,765 patent of H. Shauger et al, which discloses an electronic totalizer which is located in a two-wire transmitter that communicates via a current modulated signal with a receiving station, and the U.S. Pat. No. 4,638,451 of R. K. Hester et al, wherein a programmable central processing unit is used to control the receipt of analog data and the characteristics of electrical wave filters operating upon that data. Additionally included in this prior art is the U.S. Pat. No. 3,517,662 patent of H. T. Finch et al, wherein a patient monitoring apparatus adds a patient identifying code to a defective electrocardiogram signal that is received from the remotely-located patient; and the U.S. Pat. No. 4,451,826 patent of G. Fasching, wherein a relatively large number of remote sensor stations communicate with a master station by way of a single transmission line of the coaxial cable type.

Although each of these prior patents includes at least one aspect of similarity with the present invention, neither the individual patents nor their combination is suggestive of a system wherein a relatively large quantity of analog signal processing is disposed remotely and controlled by a central processing apparatus and additional other improvement aspects of the present invention. In this and the description to follow the term transducer is intended to include both a sensor element such as an electrical resistance strain gauge and its associated electrical circuit.

SUMMARY OF THE INVENTION

In the present invention, remotely disposed signal generating transducers are provided with a plurality of analog signal processing capabilities that are controllable from a remote data receiving or data recording apparatus by way of a single two-wire transmission path. The two-wire path, in fact, serves in the multiple capacities of data transmission, recorder-to-transducer command communication, and remote apparatus energization. The remotely disposed analog processing arrangement also enables use of a single transducer for multiple functions merely by a change of processor programming command, enables unique identification of each transducer in a large data collecting array, assures receipt of high-quality signals at the central processing apparatus, and enables the obscuring of undesirable transducer characteristics, among other advantages.

It is an object of the present invention, therefore, to provide a controllable signal preprocessing apparatus which may be located within a remotely located sensor device housing.

It is another object of the invention to provide a transducer signal preprocessing apparatus which can be remotely controlled by signals received via the apparatus output signal path.

It is another object of the invention to provide a signal preprocessing apparatus which enables use of a single type of sensor for a plurality of different signal generating functions.

It is another object of the invention to provide an improved remote transducer communication arrangement that is suitable for plural signal and energy transmission functions between a central processing apparatus and a remotely located transducer.

It is another object of the invention to provide a novel command signal communication arrangement for a remote transducer apparatus.

It is another object of the invention to provide a measuring system in which each of a plurality of measuring transducer devices can be uniquely identified at a central processing apparatus.

It is another object of the invention to provide a flexible signal preprocessing apparatus which can be once programmed and then operated without a programming apparatus in the manner of a conventional transducer and signal processing system.

It is another object of the invention to provide a remote transducer measurement apparatus in which the testing of remotely located transducers and sensors can be accomplished from a central processing apparatus.

Additional objects and features of the invention will be understood from the following description and the accompanying drawings.

These and other objects of the invention are achieved by a measuring system comprising the combination of an analog electrical measuring signal responsive recording apparatus, an analog electrical signal generating transducer member remotely disposed of the recording apparatus, and analog signal conditioning means located adjacent the transducer member and electrically connected with the output terminals thereof for selectively adding signal improving bandpass filtering, waveform differentiation, waveform integration, amplification, testing code, and transducer identification code to the transducer electrical output signal.

DETAILED DESCRIPTION

Figure 1:
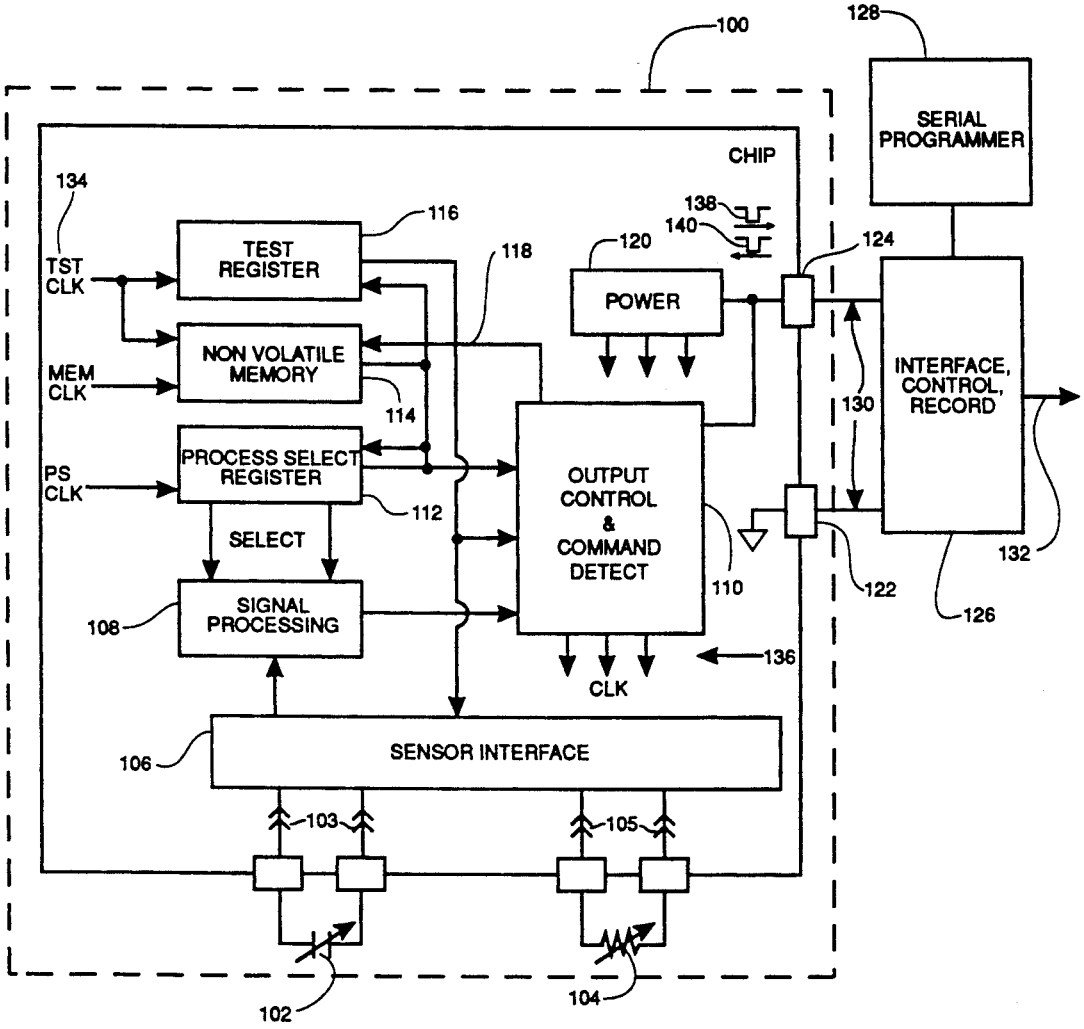
FIG. 1 is a block diagram of a programmable transducer made in accordance with the invention.

FIG. 1 in the drawings shows a transducer assembly 100 that is made in accordance with the present invention together with two cooperating pieces of apparatus used with this transducer assembly. The cooperating apparatus is herein referred to variously as a central preprocessing apparatus or a recording apparatus or an interface and control unit as is shown at 126 in FIG. 1. The serial programmer 128 is used intermittently with the FIG. 1 apparatus to set up or program certain selectable options which are included in the transducer assembly 100.

In general, the transducer assembly 100 generates analog signals which appear at the terminals 122 and 124 in processed form in response to sensed physical movement events. The movement events generate electrical signals via one of the two alternate types of sensor devices shown at 102 and 104. In the analog portion of the transducer assembly 100, the varying amplitude signal originating in one of the sensor devices 102 and 104 is received in the interface circuit 106 for amplification and coupling to the signal processing circuits of block 108. Additional details of these two blocks are shown in FIG. 3 and FIGS. 4–8 of the drawings herein. Analog signals from the signal processing circuit 108 are coupled to the output control and command detect circuitry of the block 110 in FIG. 1 for application to the two-wire communication path 130, which couples the transducer assembly 100 to the interface and control unit or recording apparatus 126.

The FIG. 1 transducer arrangement also contemplates the receipt of programming and control signals, originating in the programmer 128, at the transducer assembly 100. The same two-wire communication path 130 is also used to couple these programming and other digital signals between the interface and control unit 126 and the transducer assembly 100. The bi-directional signals at 138 and 140 on the path 130 are segregated in the block 110 and the received signals applied by way of the command bus 118 to the memory 114. Data in the register 112 is used to actuate electronic switches appearing in the analog signal processing path, as is described in detail in FIGS. 4–8 below. Part of the data in the memory 114 is used to identify each transducer 100 with respect to a plurality of similar transducers that may be present in a large measuring system; additional parts of this data perform program selection and testing functions. Data in the register 116 is used to generate testing signals in the transducer assembly 100. Clock signals for loading and unloading register 116, loading register 112 and for reading and writing memory 117 are indicated at 134 in FIG. 1; the source of these signals being the block 110, as indicated at 136 in FIG. 1. The clock signals also load into the register 116. Power for operating the electronic circuitry of the transducer assembly 100 is derived from the two-wire communication path 130 by way of the power supply circuit shown at 120 in FIG. 1. Additional details of this circuit are shown in FIG. 9 of the drawings.

According to the overall operation desired of the FIG. 1 transducer assembly, the nature of the analog signals 262 communicating along the two-wire path 130 and indeed, the mathematical nature of the transfer function between these signals and the analog input signals received from one of the sensors 102 and 104 is determined by the analog processing accomplished in the block 108. This processing in turn is selected by signals stored in the processing selection storage register 112 by way of closing a plurality of analog switching elements disposed in the signal processing circuitry of block 108. By way of differing selections of this signal processing, a given sensor at 102, for example, may be caused to generate analog signals characteristic of an accelerometer in one instance, and upon reprogramming of the signal processing circuitry, produce signals characteristic of a force measuring transducer in another instance. Selection between the sensors 102 and 104 could be accomplished by programming control, but is preferably accomplished by the physical connection changes indicated at 103 and 105 in FIG. 1 and at 203 and 204 in FIG. 2 in the preferred arrangement of the invention.

The FIG. 1 system contemplates the selection of different processings to be a real-time selection that is made under software control in a fully embodied arrangement of the invention as is represented in FIG. 1. The selection can also be a more "permanent" selection when accomplished on a less complete arrangement of a transducer system in a preliminary or laboratory setup procedure. In this arrangement the transducer assembly 100 may be preprogrammed in a laboratory procedure and then placed in service where it will perform the same function as a dedicated conventional transducer—i.e. the programmed transducer will have all the attributes of an accelerometer, for example.

One aspect of the present invention, therefore, contemplates that a single type of sensor cell may be used to generate a plurality of different analog signals by way of a relatively small package of electronic circuitry which in its ultimate form, may be contained within the housing of the sensor device itself. It is also notable that this arrangement of sensor and signal processing elements achieves the advantage of short distance communication of the low-level signal originating in the sensor device, this communication is, in fact, limited to the distance between sensor and electronic circuit all within the same package. This arrangement is especially contrasted with the usual practice of communicating low-level sensor signals over a long path to signal processing apparatus since the long path signals, signals on the path 130, have been amplified in the FIG. 1 apparatus.

Figure 2:
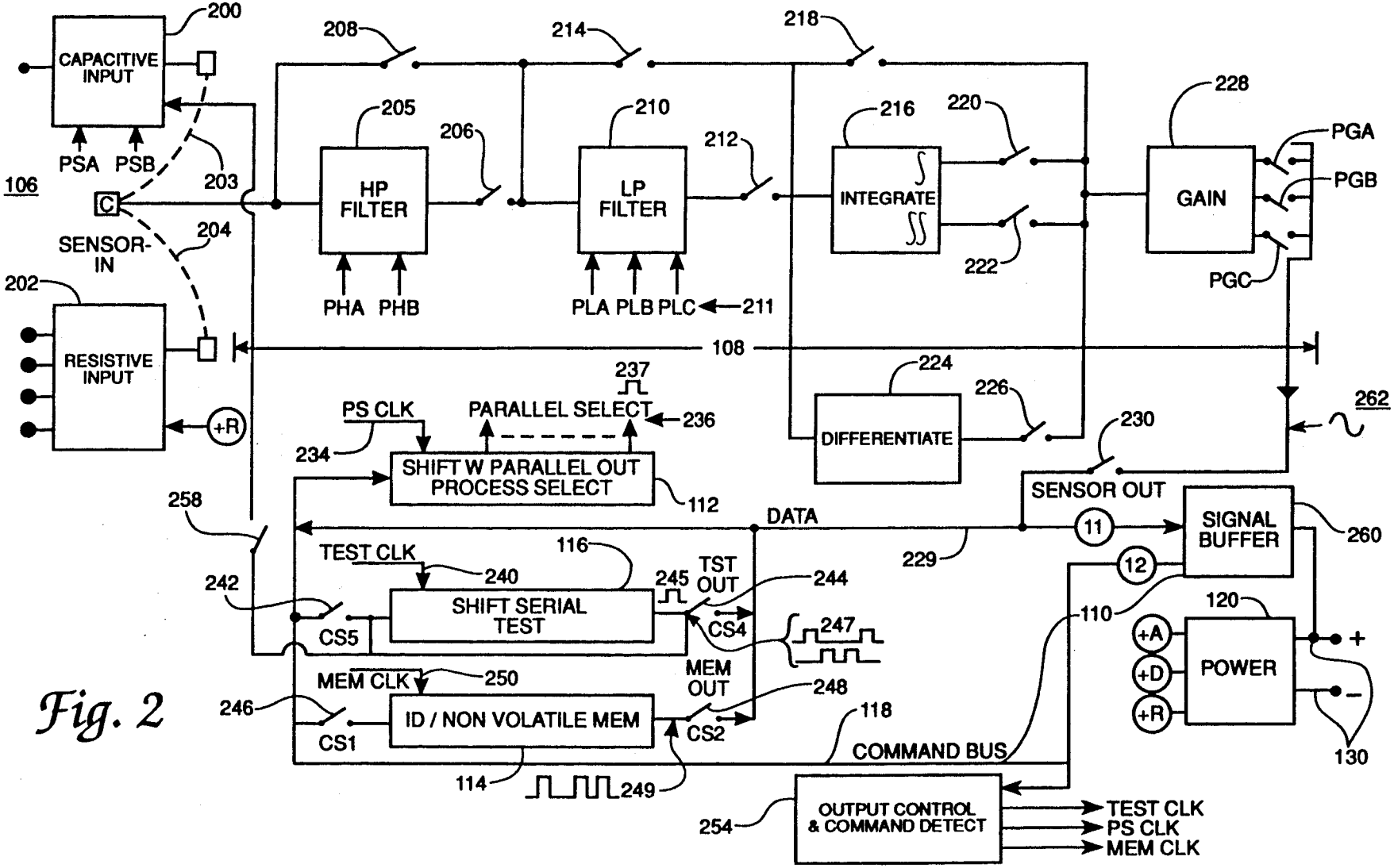
FIG. 2 shows additional details of the signal processing and other blocks in FIG. 1.

FIG. 2 of the drawings shows additional details of the FIG. 1 transducer arrangement and especially provides additional details of the sensor interface circuitry 106 and the signal processing circuitry 108 in FIG. 1. The numbers 106 and 108 are repeated in FIG. 2, along with other FIG. 1 numbers as appropriate to assist in correlating the diagrams of FIG. 1 and FIG. 2. As shown in FIG. 2, the sensor interface circuits 106 are conveniently described as two separate circuits, a capacitive input circuit 200 and a resistive input circuit 202 with the selected one of these circuits being connected by a selected signal path 203 or 204 to the signal processing circuitry 108. The paths 203 and 204 may be embodied in the form of jumper conductors on a printed circuit board, or in arrangements of the invention wherein programming control over sensor selection is desired, these signal paths may be embodied in the form of field effect transistor switches which are controllable from the process selection register 112 and the interface and control unit 126 of FIG. 1.

The signal processing circuitry 108 is shown in FIG. 2 to include a high-pass filter circuit 205 which may be incorporated into the processing by way of a switch 206 or excluded therefrom by way of the switch 208. The FIG. 2 circuit also includes a low-pass filter circuit 210 which may be incorporated by way of the switch 212 or excluded by way of the switch 214, and an integrator circuit 216 which provides both single integral and double integral output signals. The FIG. 2 circuit also includes a differentiator circuit 224 with provisions for the differentiated signals to be incorporated by way fo switch 226. The single integral signal may be incorporated by way of the switch 220 and the double integral signal by way of the switch 222. Exclusion of the integration and differentiation operations may be accomplished with closure of switch 218.

Additionally included in the analog signal processing of block 108 is the stepped gain amplifier 228 which may be used to control the output amplitude range of the FIG. 1 transducer assembly. Gains of magnitude 1, 10 and 100 are, for example, selected for use in the circuitry 228 by the switches PGA, PGB, PGC. This switch 230 can be eliminated if the logic is arranged to maintain all of the switches PGA, PGB and PGC open during appropriate conditions as explained below in connection with FIG. 8. Analog signal data from the circuitry 228 as is shown typically at 262 may be connected to the data bus 229 or excluded therefrom by way of the switch 230, this switch also being useful for opening during the communication of digital signals-signals for identification or testing purposes, for example. Additional details of the sensor interface circuitry 106 and the signal processing circuitry 108 are disclosed in connection with the electrical schematic diagrams of FIGS. 3–9 herein and the associated text below.

Control of the analog signal processing selection switches 206, 208, 212, 214 and so on, and additional digital functions that are useful in connection with the analog processing circuitry are provided by the digital circuitry shown in the lower central part of FIG. 2, in the circuitry involving the registers 112, 114, and 116. The shift register 112 which is operated by the process selection clock signal 234 generates a plurality of process selection signals 236 and 237 which are used to operate the switches 206, 208, 212, 214 and so on, in FIG. 2 and also to generate the control signals of the type indicated at 211 for the low-pass filter circuitry 210, for example. Data for accomplishing this control is communicated to the register 112 by way of the data bus 229 from the two-wire communication path 130. The clock signal 234 is derived from the output control logic circuitry 254 in response to signals received from the memory 114.

Signals stored in the testing shift register 116 are accessed by way of the test clock signal 240 which also originates in the output control logic 254 in response to signals received over the two-wire communication path 130. The signals stored in the test shift register 116 are received therein by way of the switch 242 from the command bus 118 and such test signals 245 are communicated to the interface and control unit 126 by way of the switch 244, the signal output buffer 260, and the two-wire communication path 130 to accomplish testing of portions of the transducer system. The use of selected test signals for testing the sensor cells and the analog processing circuitry is accomplished by closing the switch 258 which applies test signals to the sensor cell. Switch 242 is open and switch 230 closed and switches 244 and 248 open during such sensor cell testing. It is desired that the signals stored in the test register 116 be of several different natures, including signals 247 of selected frequency components and also signals of digital significance in order that optimum testing of the differing types of circuitry in the transducer system be possible.

In a similar manner, the data 249 stored in the memory 114 is accessed by way of the memory clock 250 which also originates in the output control logic 254 and provides transducer identification data to the data output bus 229 in response to closure of the switch 248. The nature of this identification data can be changed or controlled by way of digital signals received over the command bus 118 by way of the switch 246, the signal output buffer 260, and the two-wire communication path 130 from the interface and control unit 126.

In the system disclosed in FIG. 2 therefore, the programmable analog signal processing allows flexibility in using the output signals of a sensor cell and in fact, allows one sensor cell to fulfill many different sensing functions merely by election of the processing applied to the sensor output signal.

The digital signal apparatus shown in FIG. 2 in addition to controlling the analog processing, also provides for the elective substitution of useful signals in the form of identification and testing for the processed analog signals. It is also significant to realize that the analog signal processing provided in FIG. 2 is of such capability as to make the output signal from a FIG. 2 apparatus different in appearance than the signal received from the sensor cell at the FIG. 2 input. Particularly, the application of integration and differentiation to a received sensor signal is especially effective in changing the character of the FIG. 2 output signal.

Figure 3A:
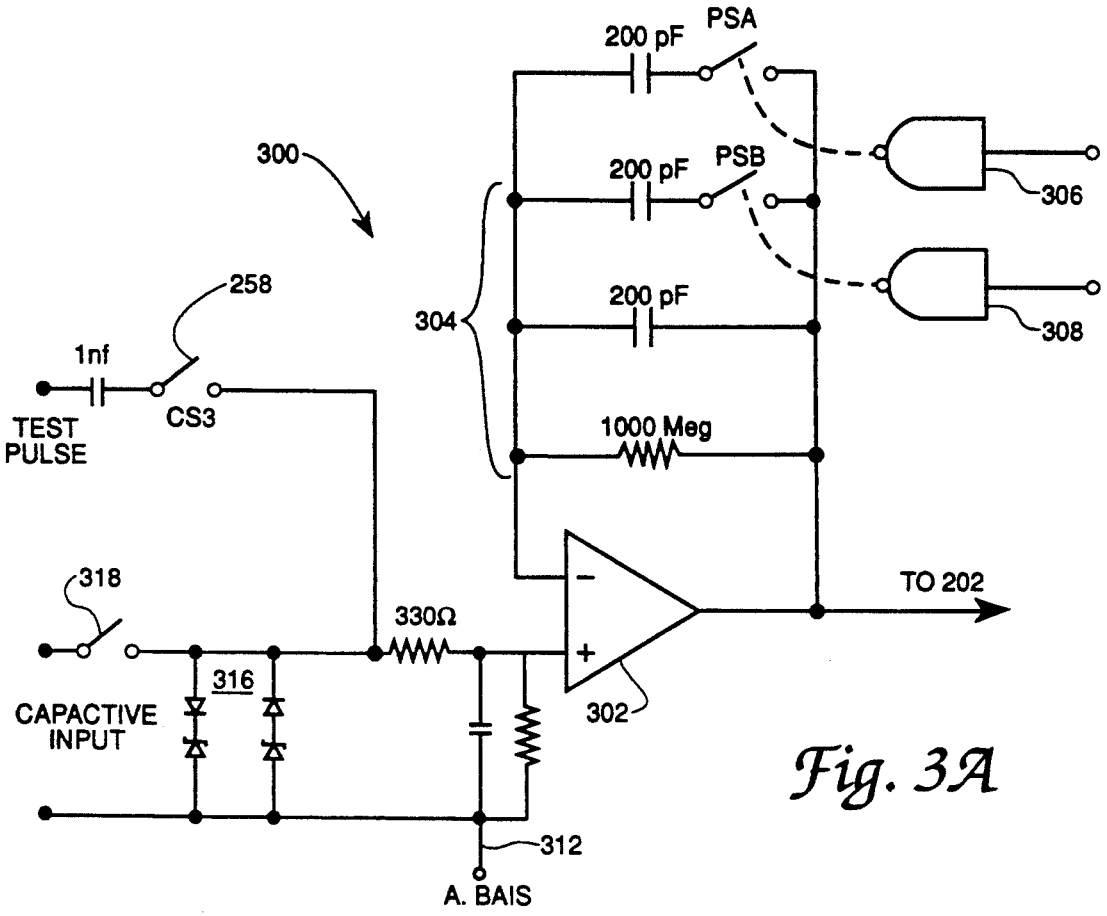
FIG. 3A shows the preferred arrangement of the capacitive input transducer interface circuit in FIG. 2.
Figure 3B:
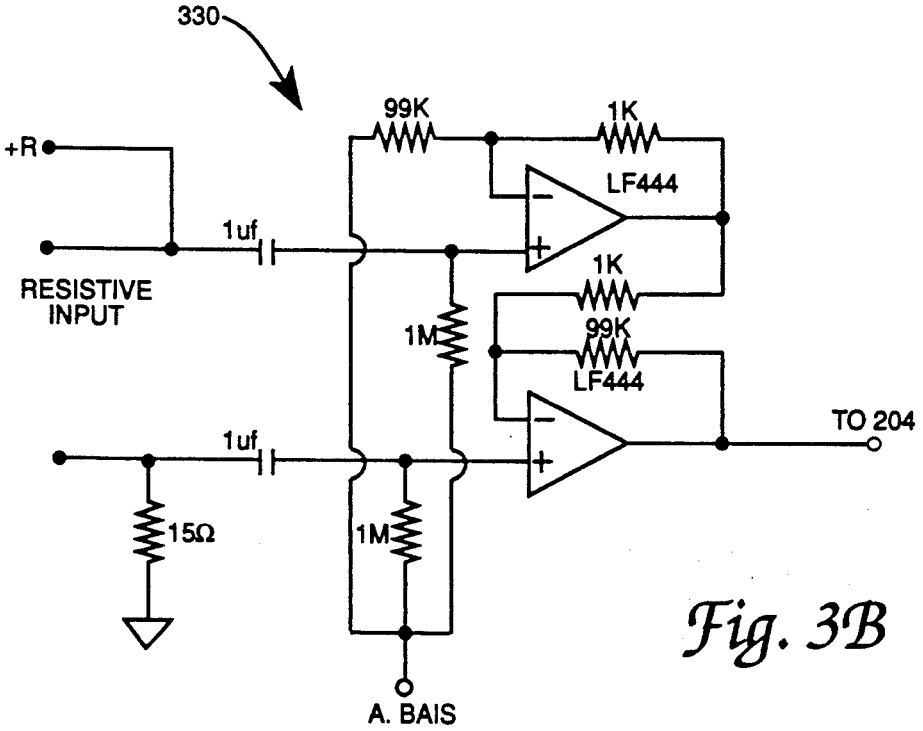
FIG. 3B shows the preferred arrangement of the resistive input transducer interface circuit in FIG. 2.

The FIG. 3A and FIG. 3B portions of FIG. 3 in the drawings shows schematic diagrams of circuitry useful for embodying the capacitive input and resistive input circuits of blocks 200 and 202 in FIG. 2. At 300 in FIG. 3A is shown, for example, the electrical circuitry usable for connecting a piezoelectric or capacitive sensor cell to the processing circuitry 108. In a similar manner, the circuitry shown at 330 in FIG. 3B is useful for connecting a variable resistance sensor cell to the processing circuitry 108. The piezoelectric coupling circuit 300 includes an operational amplifier 302 which is provided with a fixed and switch selectable feedback network 304 in order that the frequency response characteristics, the corner frequency of the amplifier output signal, be selectable in response to control signals applied to the switch drivers 306 and 308. The indicated 100 picofarad capacitors and 1000 megohm resistor in the feedback network 304 provide a corner frequency of 1.4 Hertz, for example. Other corner frequencies may be desired for different sensors and different sensor uses. The energizing of the drivers 306 and 308 changes the sensitivity of the system. Adding capacitance to the amplifier circuit results in a sensitivity change, since the sensor cell used with the circuit 300, the piezoelectric cell, is a charge-operated device and the feedback path capacitors serve to divide charge in the selected ratios. The positive input of the operational amplifier 302 is connected to a regulated source of bias potential at 312.

The diode network 316 in the FIG. 3A circuit provides clamp protection from larger than normal signal or noise inputs to the FIG. 3A circuit. The switch 318 allows disconnection of the sensor device to prevent large signal activation of the diode network 316 and long recovery times to normal operating levels, as could occur with large mechanical shocks to the sensor device and activation of the diode network 316 by the resulting large signal. Recovery from the charge displacement resulting from large signal activation of the diode network 316 must occur through the large impedances used in the amplifier input network and therefore requires a long time period—a period during which the measurement apparatus is unusable. Avoidance of this sequence is therefore to be desired and can be accomplished with the switch 318. The manner of coupling the test signal into the amplifier 302 is also shown in FIG. 3B. The output signal of the operational amplifier 302 is applied by way of the jumper 203 in FIG. 2 to the input of the next succeeding circuit, the high-pass filter which is shown in FIG. 4.

At 330 in FIG. 3B is shown a two-operational amplifier differential circuit by which signals from a resistance strain gauge sensor cell may be coupled into the processing circuitry 108 of FIG. 1. A stabilized DC current from the FIG. 9 circuit flows through a strain gauge connected to the circuit 330 and the resulting signal is AC coupled into the illustrated differential amplifier pair of operational amplifiers. The two operational amplifier (gain of 1/100 and gain of 100) instrumentation circuit shown at 330 provides high power supply rejection and offset cancellation and is a circuit that is known in the instrumentation circuit art.

Figure 4:
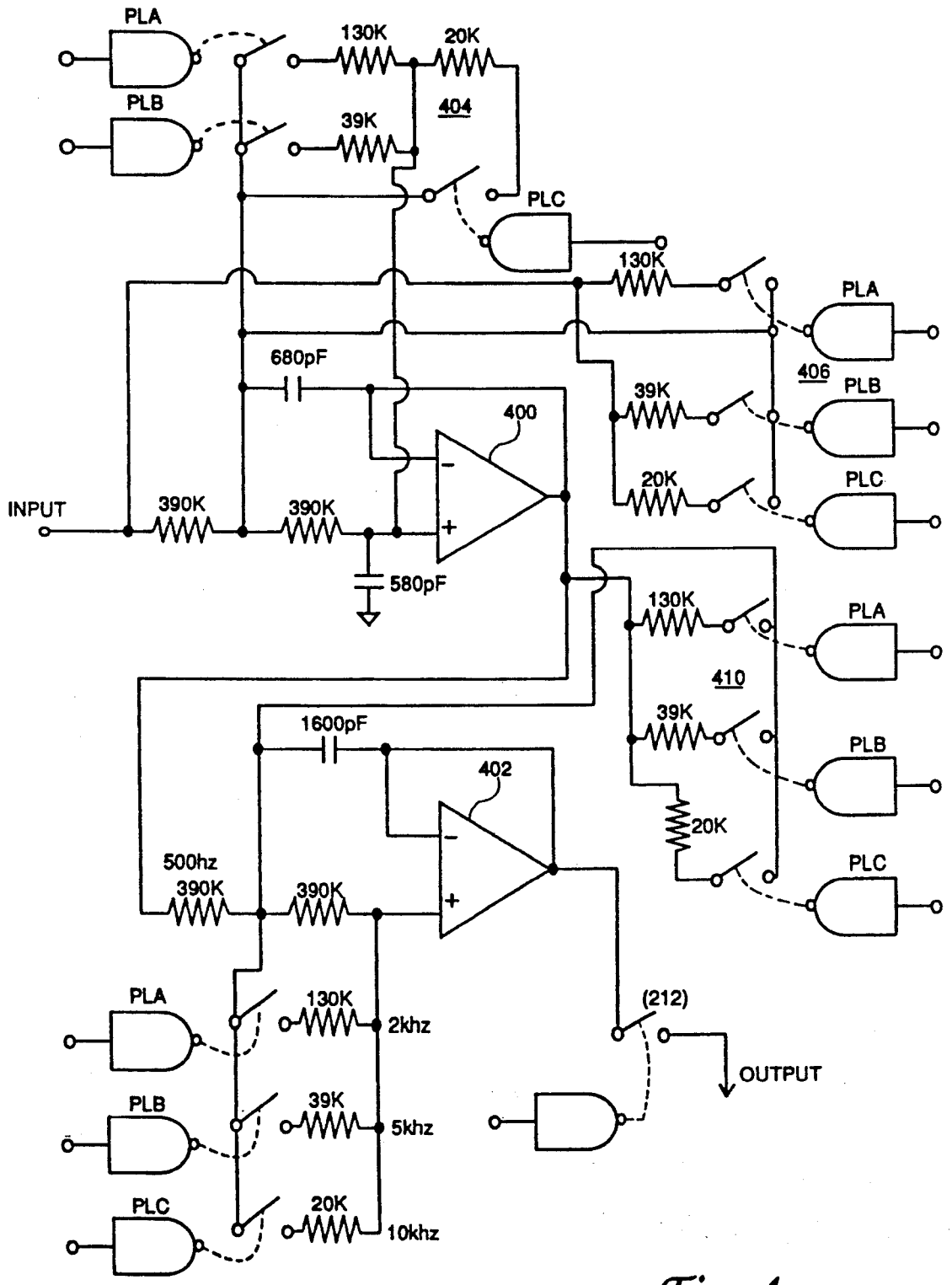
FIG. 4 shows a schematic of the preferred low-pass filter circuit in FIG. 2.

FIG. 4 in the drawings shows an electrical schematic diagram for an active low-pass filter circuit of the Butterworth type that is provided with switch selectable corner frequencies, and 24 db per octave high frequency roll-off characteristics. In the FIG. 4 circuitry, two series connected operational amplifiers 400 and 402 are each connected in the unity voltage gain, high input impedance, operating mode wherein the input signal is applied to the positive input terminal. Transistor switching devices as shown at 406 and 410, for example, provide appropriate selection of resistors in the Butterworth filter networks in order to achieve corner frequencies of 0.5 kilohertz, 2 kilohertz, 5 kilohertz, and 10 kilohertz. The transistor switches shown in FIG. 4 in addition to corner frequency selection also change the corner frequency selection of the four-pole low-pass filter. Reference numbers or reference letters appear adjacent the switches in FIG. 4 and the circuit diagrams of other figures herein to relate these switches to FIG. 1 and FIG. 2. Multiple ones of the switches in FIG. 4 and the other FIGS. herein close simultaneously—as is indicated by the identical signal name lables adjacent switch drivers in each group in FIG. 4 and the similar labeling in other FIGS. herein.

Figure 5:
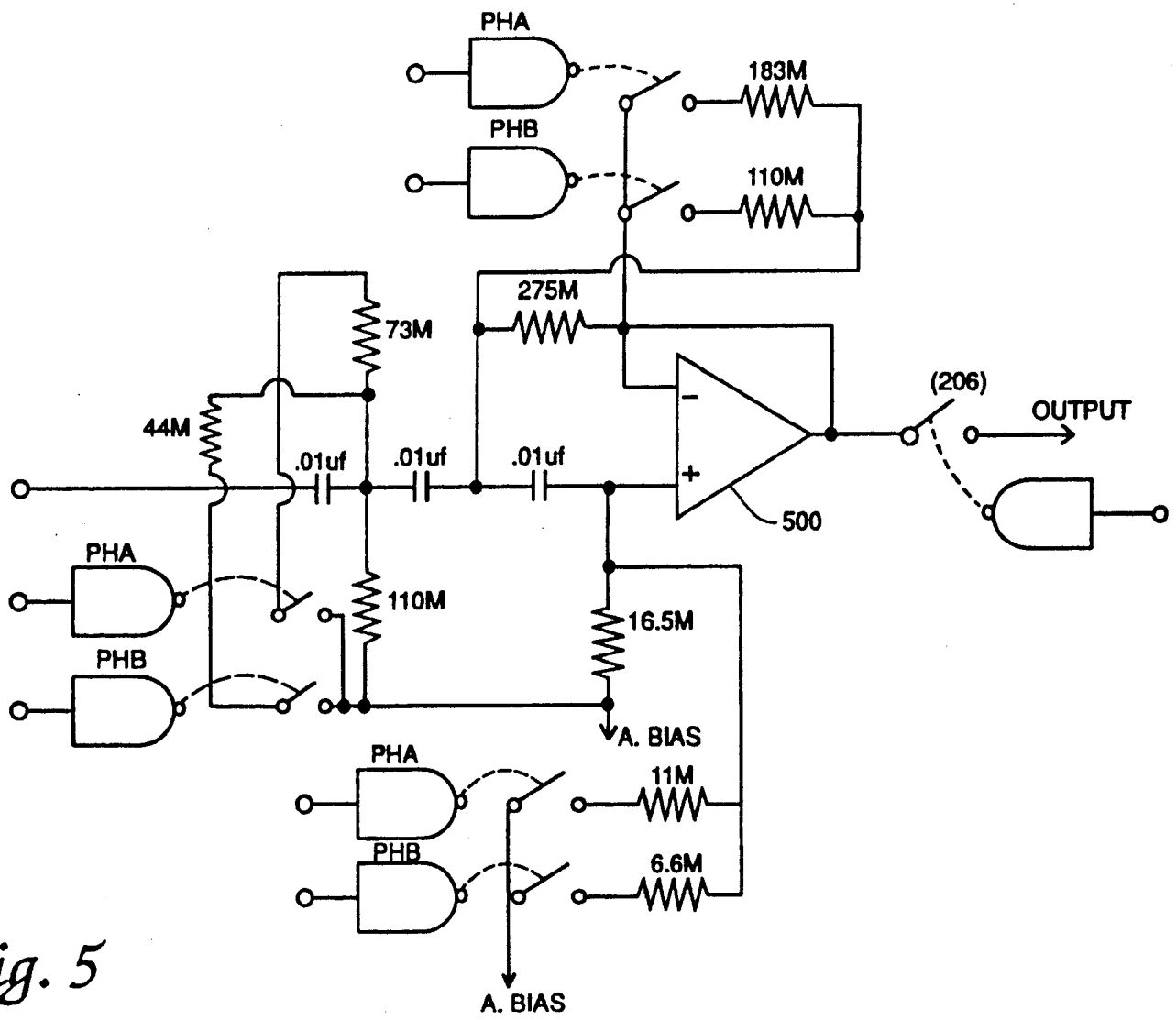
FIG. 5 shows a schematic of the preferred high-pass filter circuit in FIG. 2.

FIG. 5 in the drawings shows a schematic diagram of an active high-pass filter which also employs the Butterworth filter network and provides a three pole or 18 db per octave low frequency roll-off characteristic. The operational amplifier 500 in the FIG. 5 circuit is also connected in the high input impedance positive input terminal configuration and employs the illustrated plurality of transistorized switches for selection of input resistor values providing low frequency cutoff points of 2, 5, and 10 Hertz. The resistor values indicated in FIG. 5 are in megohms, values which are dictated by the relatively low corner frequencies specified for this circuit.

Figure 6:
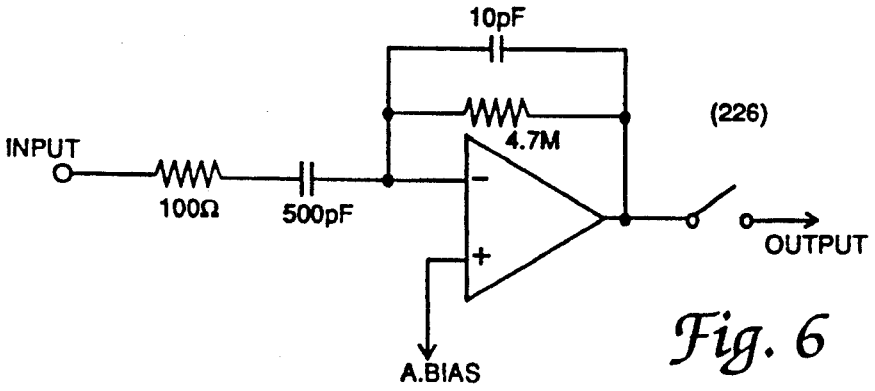
FIG. 6 shows a schematic of the preferred differentiator circuit in FIG. 2.

FIG. 6 in the drawings shows an operational amplifier which is configured into a differentiator circuit. The high frequency feedback network connected to the amplifier summing node together with the RC network connecting the input terminal to the summing node provide differentiator characteristics for the band of frequencies received from physical event transducers of the type discussed in FIG. 1.

Figure 7:
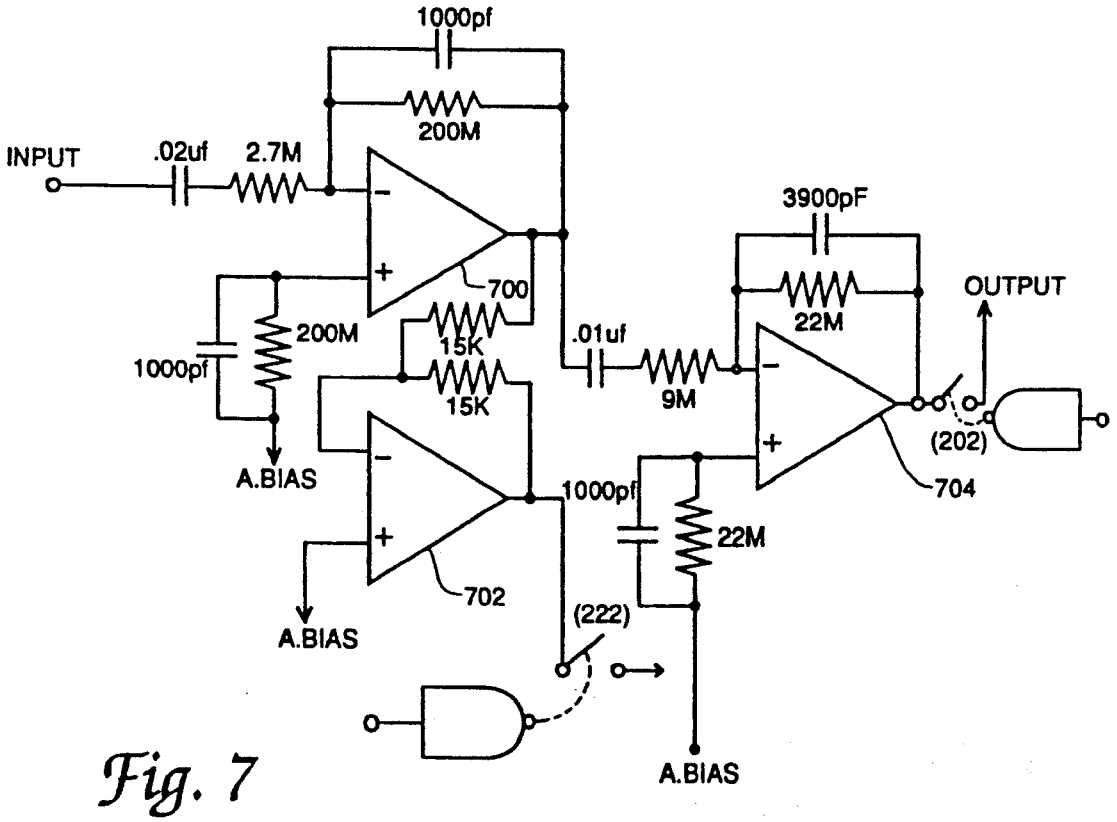
FIG. 7 shows a schematic of the preferred integrator circuit in FIG. 2.

FIG. 7 in the drawings shows a three operational amplifier embodiment of an integrator circuit suitable for use at the block 216 in FIG. 2. The FIG. 7 circuit provides both single integral and double integral output signals that are selectable by way of transistorized switching elements. In the FIG. 7 circuit, a first integration is performed by the operational amplifier 700 which is provided with an alternating current coupled input network and a highly capacitive (1000 uf capacitor) negative feedback into the amplifier summing node. For use of the single integration output signal, the operational amplifier 702 provides signal inversion and integrator buffering. For double integration, this signal inversion function as well as the second integration is provided by the third operational amplifier 704 which is also provided with AC input coupling and a heavily capacitive negative feedback to the summing node. The A Bias connected operational amplifier terminals in the FIG. 7 integrator circuits and the other analog processing circuits of the invention are connected to the analog bias source output of the power supply. Operation of these terminals at a biased voltage level as opposed to the usual grounded connection of such terminals allows single power supply operation of the operational amplifier circuits in the present signal processing apparatus. The output terminals of the FIG. 7 integrators and the differentiator circuits of FIG. 6 are connected to the input terminal of the gain stage of FIG. 8.

Figure 8:
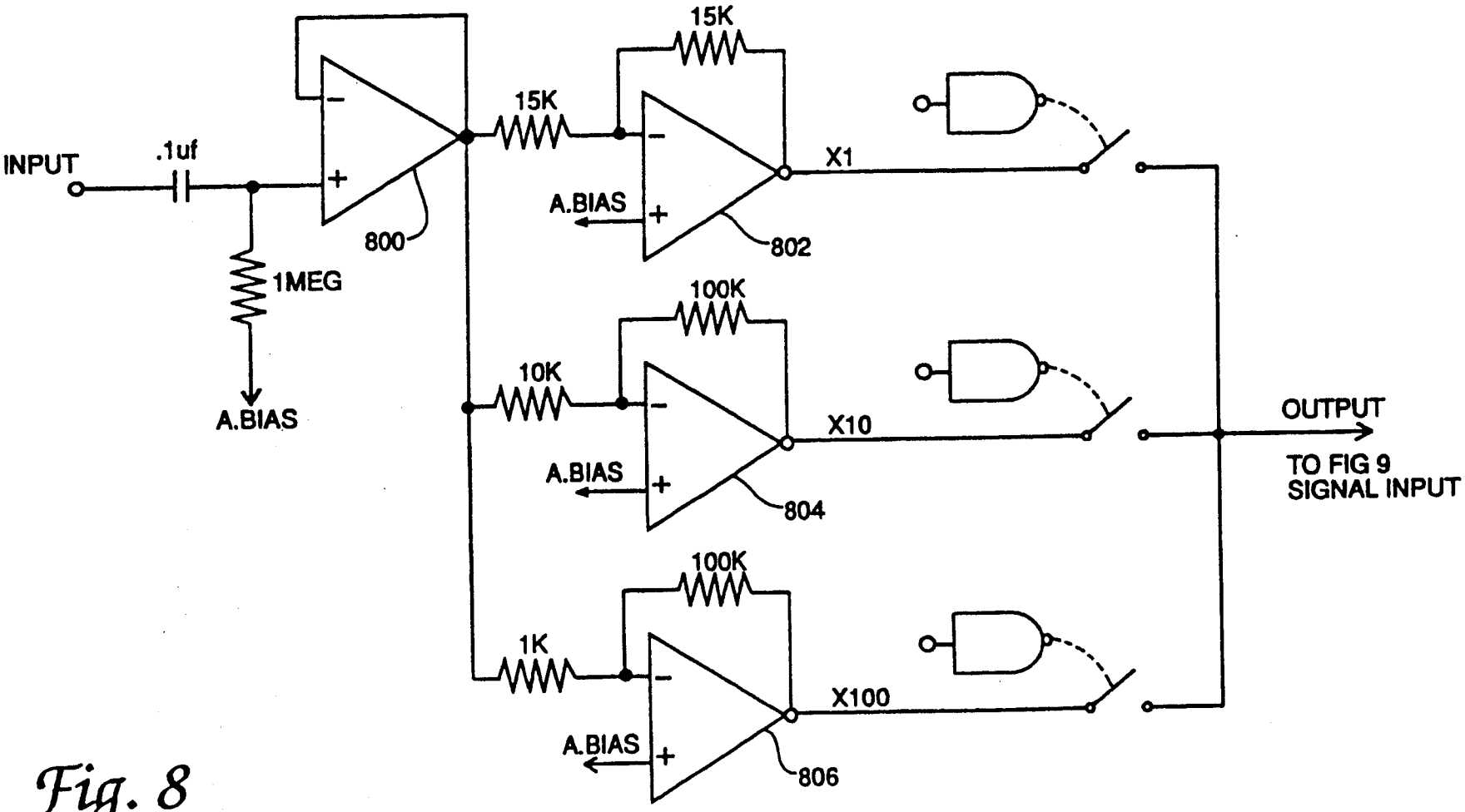
FIG. 8 shows a schematic of the preferred stepped gain amplifier circuit in FIG. 2.
Figure 9:
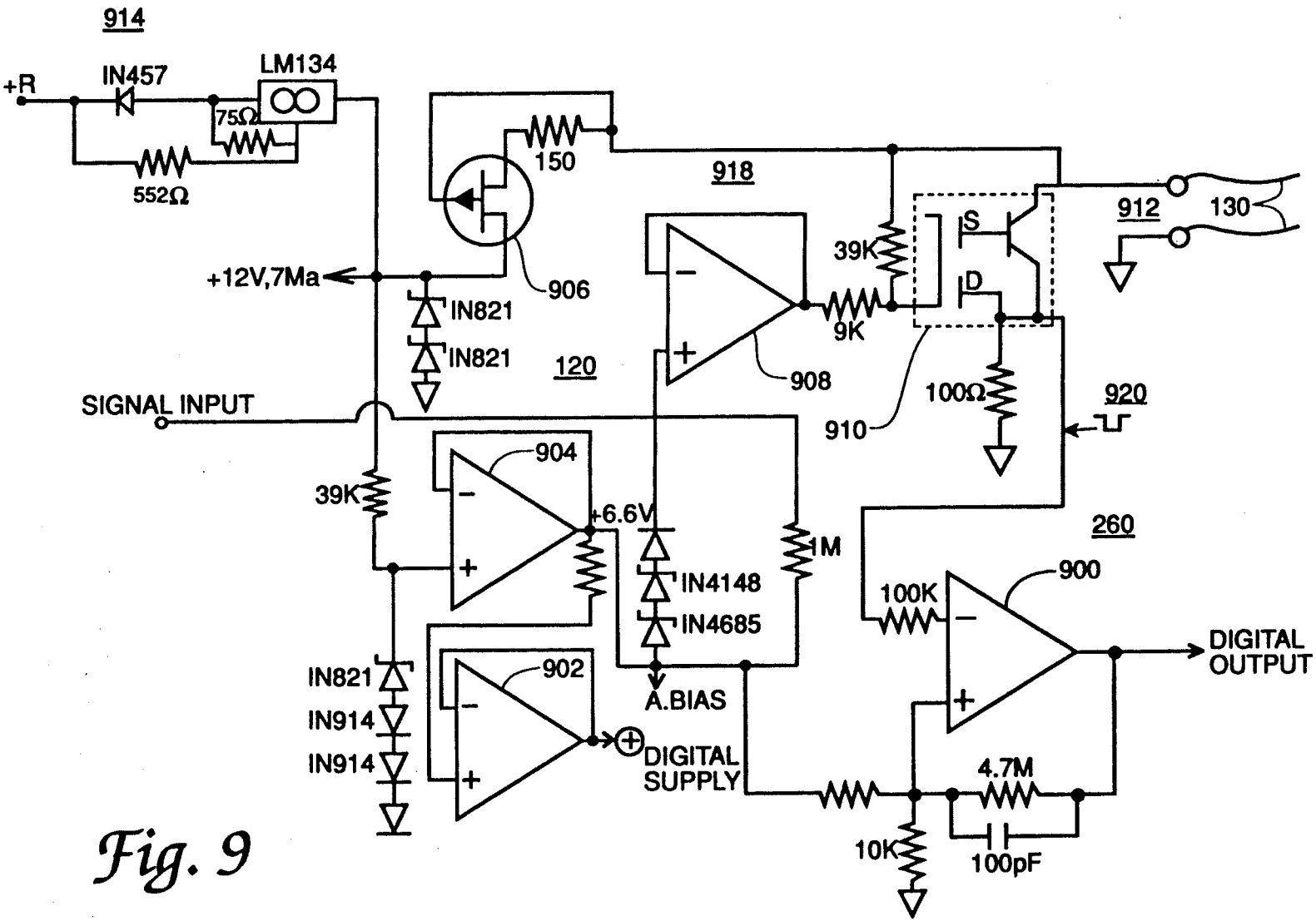
FIG. 9 shows a schematic of the preferred communication line isolator and power supply in FIG. 2.
Figure 10A:
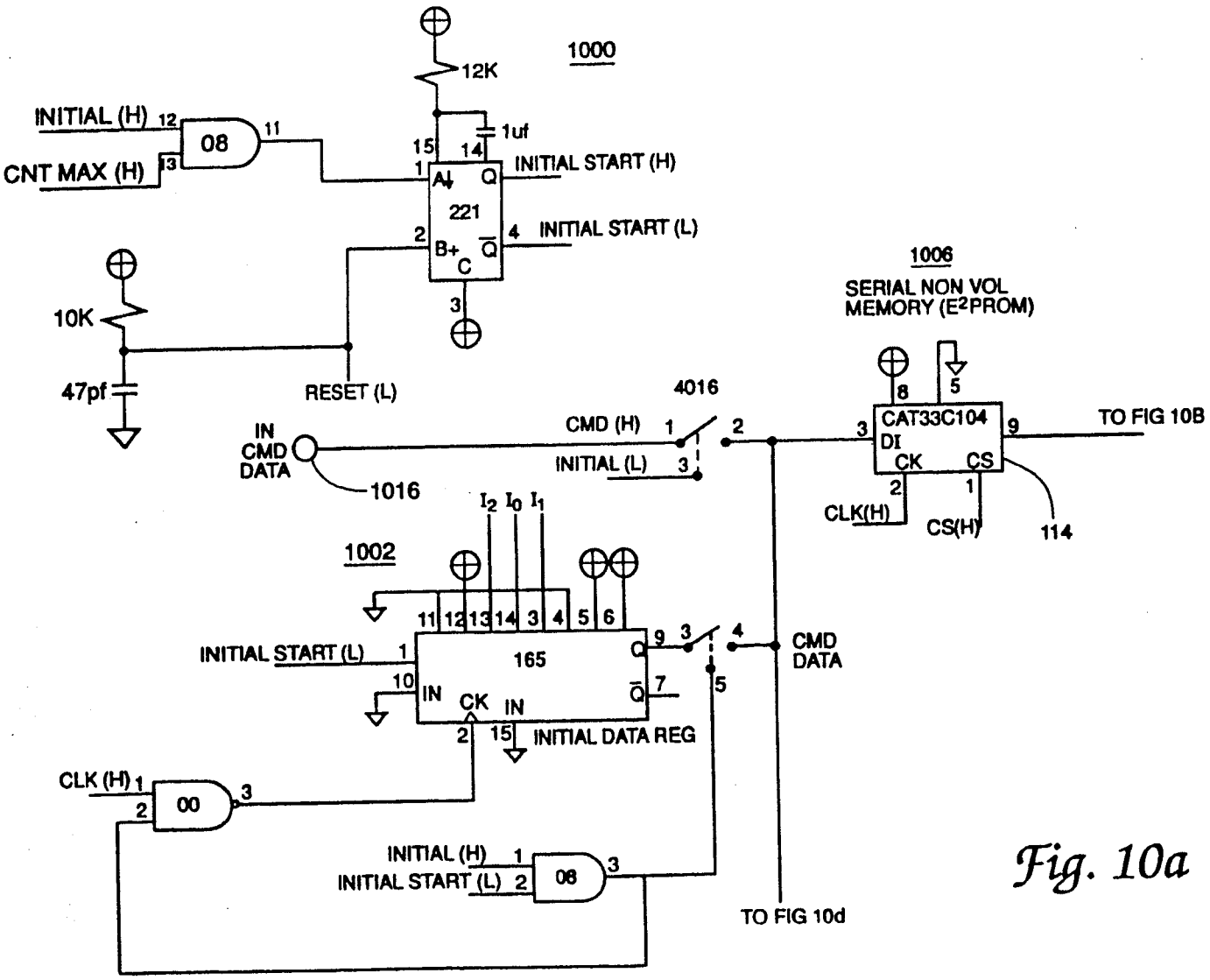
FIG. 10 including the portions of FIG. 10*a*, FIG. 10*b*, FIG. 10*c
* and FIG. 10*d* shows details of the digital circuits in FIGS. 1 and 2.
Figure 10B:
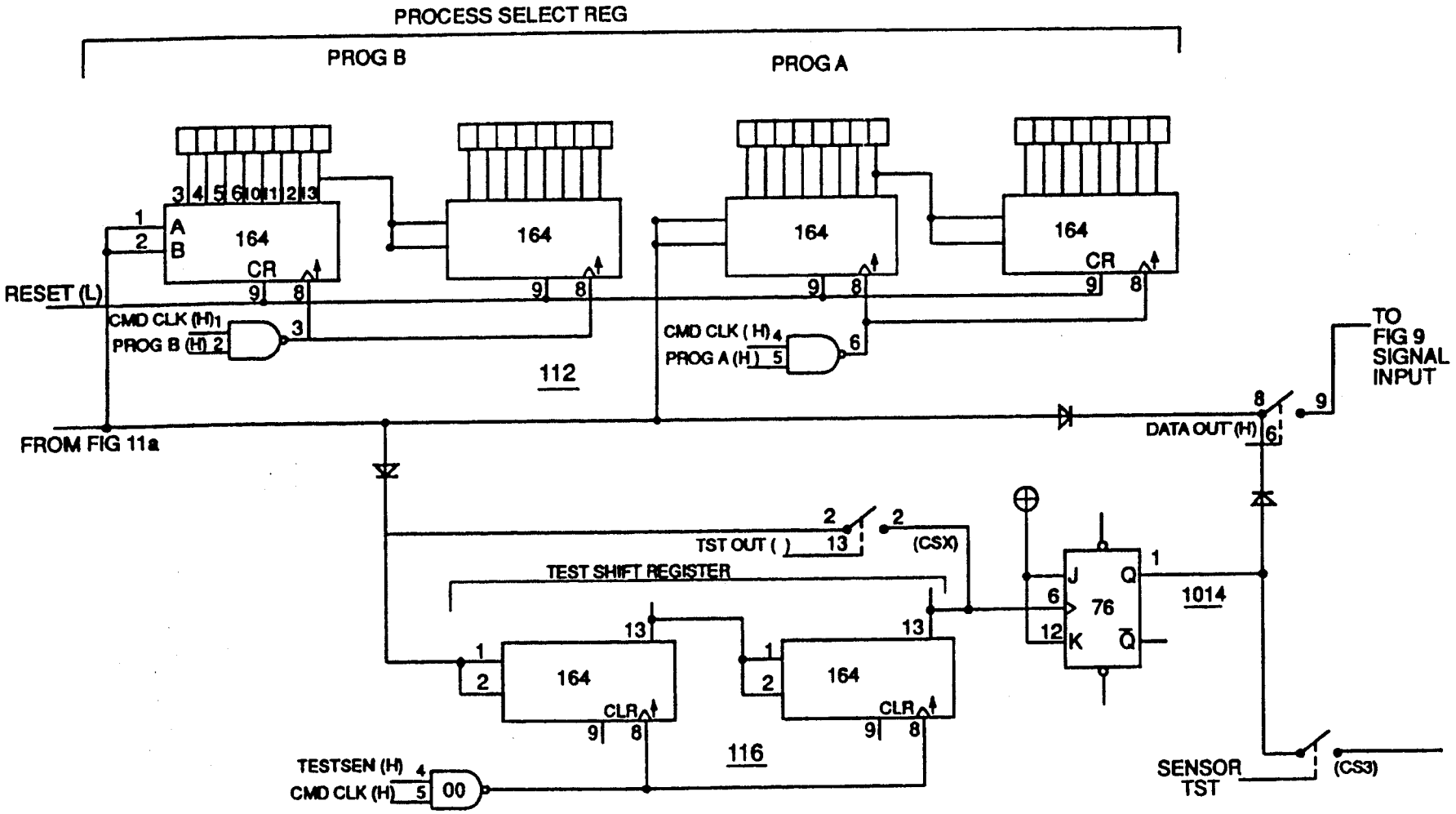
Figure 10C:
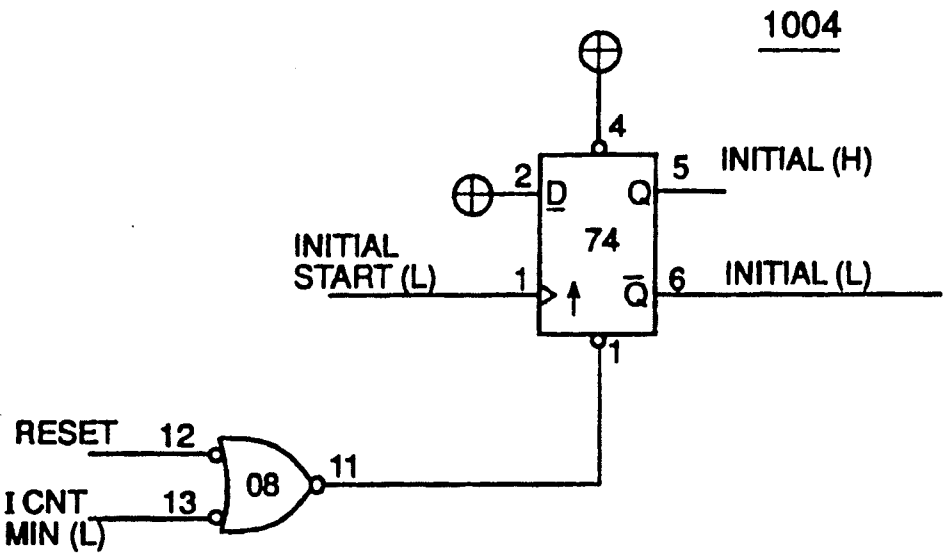
Figure 10D:
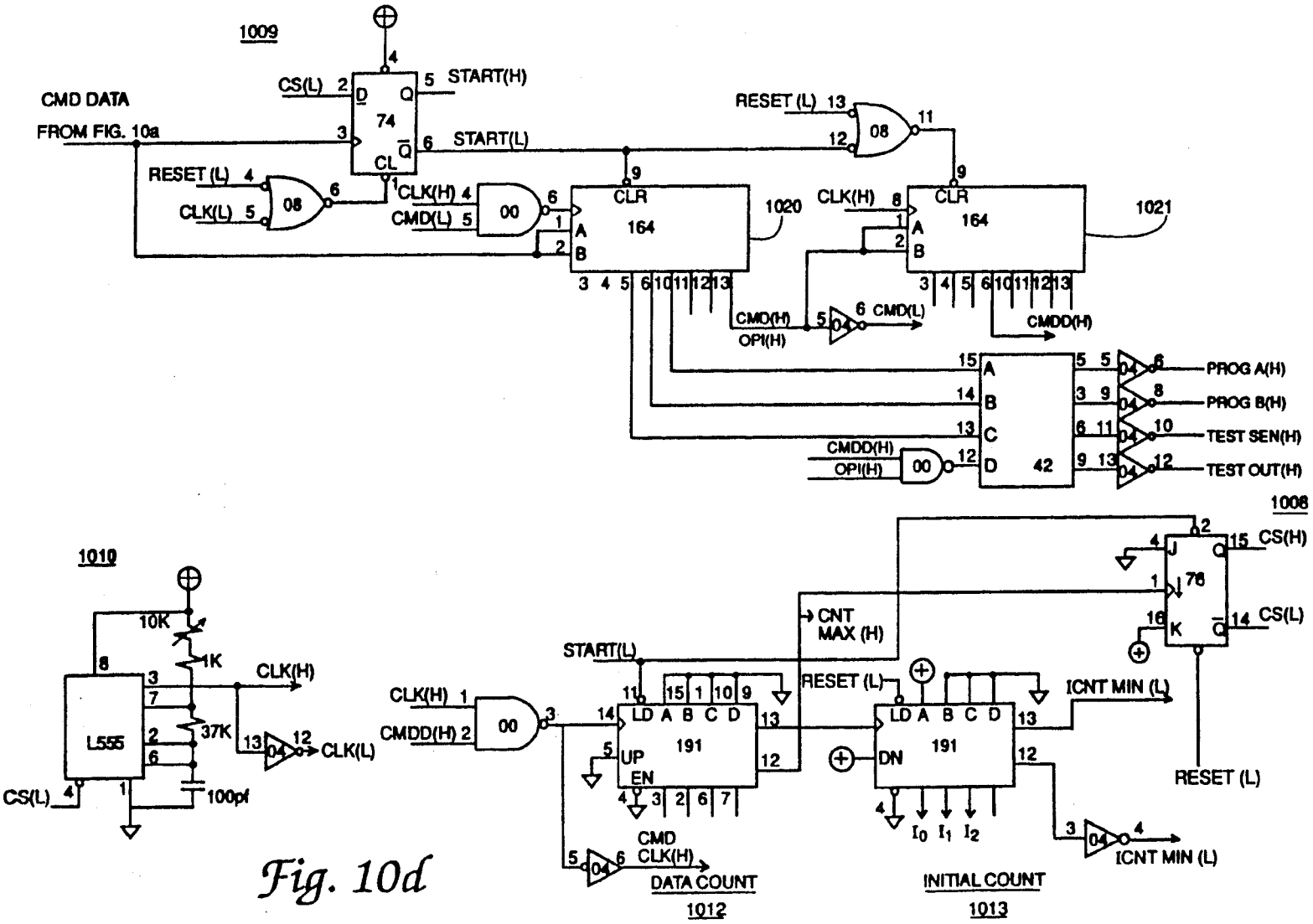

FIG. 8 in the drawings shows a preferred arrangement of the gain stage 228 in FIG. 2, an arrangement providing gain values of 1, 10 or 100 according to the utilized one of the amplifiers 802, 804, and 806. Each of these operational amplifiers have appropriately ratioed resistors in the input and negative feedback signal paths thereof. AC coupling, high input impedance, and unity amplification gain are provided by the buffer amplifier 800 in FIG. 8 which is connected to drive the three gain selected amplifiers 802, 804, and 806. In the absence of closing one of the gain selection switches in the output circuit portion of FIG. 8, sensor signal is excluded from the output of the FIG. 8 circuitry. This absence can be used to replace the switch 230 which was described in connection with FIG. 2 above with suitable accompanying accommodations in the digital portions of the system.

FIG. 9 of the drawings shows a schematic diagram of circuitry embodying the power supply 120 and the signal buffer 260 in FIG. 2. In the FIG. 9 schematic diagram, the two-wire communication path 130 in FIGS. 1 and 2 is received at the port 912 and the signals and energy appearing on this path are coupled into three different circuit by the amplifying devices shown at 900, 906, and 908. The two-wire communication path at 912 in FIG. 9 is presumed to have a nominal current flow in the range of 10 milliamperes and a nominal voltage potential of 24 volts. These 10 milliamperes and 24 volts are, of course, the totality of the operating power available for the sensor cell and the circuitry located at the sensor cell; in the present invention the resulting 240 milliwatt power level is believed to be another significant improvement over prior transducer systems. For the purpose of sending digital information to the transducer circuitry, the nominal 10 milliamp current flow is increased to 20 milliamperes for the duration of a digital signal pulse.

The function of deriving steady state power supply voltages from this 10 and 20 milliampere, 24 volt DC energization of the two-wire communication line is accomplished by the amplifier devices 902, 904, and 906 in FIG. 9. The field effect transistor device 906 in this group serves as a source follower circuit and has an output voltage in the range of 12 volts and a current output in the range of 7 milliamperes. The voltage output level of this circuit is determined by the shunt connected zener diodes connected to the transistor 906 source terminal. An additionally filtered and lowered bias voltage, a voltage in the range of 6.6 volts, is provided by the operational amplifier 904 which is connected in a unity gain high input impedance configuration to duplicate the voltage developed across the diode string appearing at its positive input terminal. This 6.6 volt source is used for analog circuit purpose in the described circuits. A yet additionally filtered DC source is provided by the operational amplifier 902 which is also connected as a high input impedance unity gain circuit. This additional source is used for digital circuit energizing and signals and is identified with the circled plus sign symbol shown in FIGS. 9 and 10. A temperature compensated, low temperature coefficient constant current source for energizing the resistance strain gauge sensor cell used with the circuit 330 in FIG. 3 is shown at 914 in FIG. 9; the +R symbol output of this source establishes a current flow in the resistance strain gauge and the 15 ohm resistance of the circuit 330.

For communicating digital signals to the two-wire communication path at 912, the circuits 918 including the operational amplifier 908 is used. The input for the amplifier 908 are received from the data lines 229 in FIG. 2. The high input impedance and current source output feedback pair 910 are used to actually drive the two-wire communication path 130. The pair 910 may be embodied in the form of a TAA 320 integrated MOS amplifier circuit or the equivalent 3N163/2N3907 device, all of which are available from a number of commerical semiconductor suppliers.

Digital signals received from the interface and control unit 126, that is signals encoded as the change from 10 milliamps to 20 milliamp current flow in the 2 conductor pair 130, appear, as at 920, across the 100-ohm resistor in the drain terminal of the pair 910. These signals are amplified in the operational amplifier circuit 900 which is connected in the form of a comparator circuit to an appropriately selected bias voltage in order to provide a digital output signal.

DIGITAL SYSTEM

Additional details of the registers 112, 114, and 116 appearing in FIGS. 1 and 2 herein and other details of the digital circuitry used in embodying the invention are disclosed in FIG. 10 of the drawings. FIG. 10 is segregated into the four parts of FIGS. 10*a*, 10*b*, 10*c*, and 10*d* and these parts may be physically joined in a two-wide, two-high pattern for signal tracing purposes. The numbers 112, 114, and 116 are repeated in FIG. 10 to enable correlation with the FIG. 1 and 2 block diagrams of the transducer processing system. In addition to these repeated elements, FIG. 10 also shows seven cooperating digital circuit collections which are identified with the numbers 1000, 1002, 1004, 1006, 1008, 1010, 1012, and 1014, whose function is discussed below. The manufacturer's identification number for the logic circuits used in the FIG. 10 apparatus appears within the circuit symbol. For all excepting the clock and memory circuits 1010 and 1006 the Table 1 disclosed prefix of 74HC precedes this identification number.

Digital signals for operating the FIG. 10 system are received on the node 1016 from the analog signal segregating operational amplifier 900 in FIG. 9 and the conductors 130 and appear as a high level on the node 1016. These signals become the CMD DATA signal in FIG. 10 except during an initialize operation. During such an operation data is generated by the initialize data register 1002 in FIG. 10. The CMD DATA is received at the serial memory 1006, at the start flip-flop 1008, and at the CMD SHIFT REGISTER 1021 in the FIG. 10 system.

The presence of a high logic level or the CMD DATA line in FIG. 10 is used to commence the sequence of clocking data into the CMD SHIFT REGISTER 1021, by setting the chip select flip-flop 1008 by starting the clock oscillator 1010 and clearing the CMD SHIFT REGISTER 1021. The CMD SHIFT REGISTER 1021 senses when the first bit of data has reached the bit 8 position of the register where the bits of the input command will in fact line up with their proper bit locations. At this point the CMD signal is active and stops the clocking of the CMD SHIFT REGISTER.

Clocks to the memory 114 continue however and the sequence is delayed by the CMDD signal from register 1021 until the complete op code and memory address of eleven bits is loaded into the memory. The delay is actually three more clock bits than the eight bits transferred in the command words and is limited in order to match the RS232 single character transfer protocol of eight bits maximum.

When the CMDD delay is complete sixteen more clock bits are counted in the DATA COUNT REGISTER 112 to allow for the data transfer. For read commands, the data on the CMD DATA line is ignored by the memory 114 since the memory is outputting data. For writing the memory the CMD DATA is present and will be loaded. At the count of 16, the memory is deselected by an inactive CHIP SELECT signal from flip-flop 1008, the START FLIP-FLOP 1009 is enabled for another transfer, and the clock is reset.

For a read operation the data to be read is shifted from the serial memory 1006 to the transducer output circuit of FIG. 9 and also to the process select register 112 for program A and B commands (i.e. the commands which control the function and control selection switches), and to the text register 116 for test commands. The transducer identification code does not need to be placed in a register since it is transferred directly to the FIG. 9 output circuit by a read ID or identification command.

A test pulse train is generated by recycling the TEST SHIFT REGISTER 116 output signal to its input and by using the shifted output bit location to toggle the J-K flip-flop shown at 1014. By programming different bit locations in the test register, various frequencies and waveforms for the test signal can be created. The output from the test pulse flip-flop 1114 is switched either to the transducer output circuit of FIG. 9 or to the sensor element by the switches shown in FIG. 11 which are controlled from the program register.

An initialize operation for achieving a default or nominal operating condition in the system is automatically initiated upon power up of the system. A program A and B command is required to be loaded into the PROCESS SELECT REGISTER 112 to re-establish the minimum programmed data. The default condition of the process select register 112 sets the transducer in the sensor out state upon power up. It is also desirable to have the transducer identification code sent to the interface or recorder apparatus 126 of FIG. 1. These three default read commands are accomplished by switching the INITIAL DATA REGISTER 1002 to the CMD DATA line. The FIG. 10 sequence then proceeds exactly as if data were arriving from the CMD DATA IN node 1016. The Initialize CNT outputs from the register 1013 are used to switch the INITIAL DATA REGISTER 1002 inputs at the proper time to create the different operating codes required for the three commands. The INITIAL COUNTER 1013 also terminates the INITIAL operation after Transducer ID op code transfer.

Table I below provides commercial identification of the semiconductor devices used in the FIG. 3 through FIG. 9 schematic diagrams. Substitutions for the identified commercial parts may, of course be accomplished by persons skilled in the electronic art.

TABLE I

| Part Identification | Location | Commercial Designation |
|---|---|---|
| Op amp 806 | — | Motorola MC 34181 |
| Op amp 900 | — | CA 3290A |
| Transistor 906 | — | J271 |
| FET Analog Switches | All Locations | 4016B Isolated Switch |
| All other op amps | All locations | LF444 or MC 34181 |
| Feedback amp 910 | — | TAA320, LTA320, 3N163, 2N3907 |
| Digital logic | FIG. 10 | 74HC family |
| Serial Non Vol Memory | 1006, FIG. 10 | CAT 33C104, Catalyst Semiconductor Corp., Santa Clara, California |
| Low Power Clock Generator | FIG. 10 | |

The present invention therefore provides an improved arrangement for data measurement transducers in which significant portions of the desired signal processing are accomplished in circuitry located adjacent the transducer sensor cell and the processed signals communicated to a receiving apparatus via a simple and low-cost communications link. In addition to enabling use of a single sensor cell for multiple purposes, the invention also provides for preprogramming of a transducer's electronic circuit and use of the transducer in a simple system that does not include programming apparatus. The transducer of the invention operates over the −40 to +121 degree Celsius range and requires only 240 milliwatts (24V, 10Ma) of energization, which is also accomplished via the simple and low-cost communication link.

While the apparatus and method herein described constitute a preferred embodiment of the invention, it is to be understood that the invention is not limited to this precise form of apparatus or method, and that changes may be made therein without departing from the scope of the invention, which is defined in the appened claims.

We claim:

1. Programmable preprocessor apparatus disposable adjacent a remotely-located mechanical event to electrical signal analog sensor device for communicating processed analog output signals therefrom and for processing digital control signals thereto, said apparatus comprising:

first sensor signal preamplifier electronic circuit means for coupling the output signal of an analog charge generating embodiment of said mechanical event to electrical signal analog sensor device into said preprocessor apparatus;

second sensor signal preamplifier electronic circuit means including a variable resistance sensor energizing source of electrical potential, for coupling the output signal of a variable resistance embodiment of said mechanical event to electrical signal analog sensor device into said preprocessor apparatus;

electrical wave filter electronic circuit means of first predetermined high-pass network S plane pole count and selectable lower corner frequency and of second predetermined low-pass network S plane pole count and selectable upper corner frequency, for limiting the low frequency and high frequency signal components respectively in said processed analog output signals;

first and second analog integrator electronic circuit means for generating mathematical first integral and second integral signals of said sensor electrical signal as components in said processed output signals;

signal amplifier electronic circuit means of predetermined selectable increments of amplifier gain for adjusting the voltage output of said sensor device into a convenient volts per engineering unit range;

first digital means for storing coded command signals determinative of the inclusion and exclusion of individual ones of said six electronic circuit means, and predetermined circuit components relating thereto, in said processed output signals;

second digital memory means for storing a selectively accessible test signal generating code;

third digital memory means for storing a selectively accessible coded sequence of numbers identifying said sensor with respect to additional of said sensors in a plural sensor array and for storing a selectively accessible decoded sequence of numbers representative of processed output signals of said preprocessor apparatus;

buffer driver circuit means for coupling digital signals from said first, second, and third digital memory means and analog signals from said signal amplifying means onto a two conductor communications line and for sensing the presence of command signals received via said communications line at said preprocessor apparatus; and power supply means for energizing electronic components of said preprocessor apparatus with electrical energy received at said mechanical event remote location via said two conductor communications line.

2. The preprocessor apparatus of claim 1 wherein said power supply means include means for communicating analog signals onto said two conductor communications line, digital signals onto and from said two conductor communications line, and preprocessor apparatus energizing energy from said two conductor communications line.

3. The preprocessor apparatus of claim 1 wherein said power supply means also includes bias signal generating means for energizing variable resistance sensors connected with said second sensor signal preamplifier electronic circuit means.

4. The preprocessor apparatus of claim 1 wherein said apparatus further includes analog differentiator electronic circuit means, and said analog integrator electronic circuit means and said analog differentiator electronic circuit means each include active electronic circuits comprised of a feedback connected amplifier.

5. The preprocessor apparatus of claim 1 further including electronically controllable switching elements for controlling the circuit path followed by analog signals therein.

6. A measuring system comprising the combination of:

an analog electrical signal responsive recording apparatus;

an analog electrical signal generating mechanical displacement to electrical signal transducer cell member remotely disposed of said recording apparatus;

and analog signal conditioning means located adjacent said mechanical displacement to electrical signal transducer cell member and electively connected with output terminals thereof for selectably adding transducer signal waveform improving bandpass filtering, waveform differentiation, waveform integration, amplification, digital testing code, and transducer cell digital identification code to said transducer cell member electrical output signal.

7. The measuring system of claim 6 further including signal conveying means having a two conductor signal path connecting said signal conditioning means with said recording apparatus for conveying conditioned mechanical displacement to electrical signal transducer cell signals to said recording apparatus and for selecting said signal improving additions to said conditioned signal.

8. The measuring system of claim 7 wherein said two conductor signal path is energized with a constant electrical current from said recording apparatus.

9. The measuring system of claim 8 wherein said transducer cell member consists of one of the group of transducer types of a piezoelectric signal generating cell and an electrical resistance change responsive cell and wherein said signal conditioning means includes alternately selectable electric circuit means for receiving signals from a selected one of said transducer types.

10. The measuring system of claim 8 wherein said bandpass filtering includes both high-pass and low-pass filtering and means for selecting a location for a predetermined number of corner frequencies in each.

11. The measuring system of claim 10 wherein said waveform integration includes individually selectable single and double integration.

12. The measuring apparatus of claim 11 wherein said analog signal conditioning means includes means for generating digital pulses of programmable frequency spectra.

13. The measuring system of claim 12 wherein said analog signal conditioning means includes software controlled binary coded signal generating means for uniquely identifying each transducer cell of a multiple transducer cell group.

14. The measuring system of claim 6 wherein said recording apparatus includes digital signal generating means and wherein said analog signal conditioning means includes digital signal receiving and decoding means connected to individual analog circuits in said analog signal conditioning means for communicating analog signal conditioning selection signals to said remotely disposed analog signal conditioning means.

15. The measuring system of claim 6 wherein said analog electrical signal generating mechanical displacement to electric signal transducer cell member comprises a piezoelectrical signal generating crystal and wherein said analog signal conditioning means further includes test signal generating means for connecting a piezoelectric crystal verifying test signal with said crystal and communicating the resultant signal to said recording apparatus.

16. The measuring system of claim 6 wherein:

said transducer cell includes an electrical charge generating piezoelectric element; and said transducer cell member to signal conditioning means connection is comprised of switching means for terminating communication between said sensor cell and said signal conditioning means in advance of voltage limiting network activating predictable large transducer cell signal measurement events;

whereby large piezoelectric charge displacement and long recovery time disabling of said measuring system in response to activation of said voltage limiting network is precluded.

* * * * *